United States Patent [19]

Ipson

[11] Patent Number: 4,945,281

[45] Date of Patent: Jul. 31, 1990

[54] FLAT LIGHT SOURCE

[75] Inventor: Stanley S. Ipson, Bradford, United Kingdom

[73] Assignee: Sidefact Limited, Bradford, England

[21] Appl. No.: 220,110

[22] PCT Filed: Jan. 15, 1987

[86] PCT No.: PCT/GB87/00017

§ 371 Date: Sep. 16, 1988

§ 102(e) Date: Sep. 16, 1988

[87] PCT Pub. No.: WO87/04562

PCT Pub. Date: Jul. 30, 1987

[30] Foreign Application Priority Data

Jan. 17, 1986 [GB] United Kingdom ..... 8601185
Aug. 19, 1986 [GB] United Kingdom ..... 8620172

[51] Int. Cl.[5] ..... H05B 41/00; H01J 17/34
[52] U.S. Cl. ..... 315/58; 315/324
[58] Field of Search ..... 350/345; 315/58, 62, 315/71, 260, 334, DIG. 1, 312, 324

[56] References Cited

U.S. PATENT DOCUMENTS 3,047,763 7/1962 Inman ..... 313/493

FOREIGN PATENT DOCUMENTS 0180067 11/1982 Japan .
0103761 6/1983 Japan ..... 315/71
0127357 7/1984 Japan .
0012660 1/1985 Japan .
0527060 10/1940 United Kingdom .

OTHER PUBLICATIONS

Phillips, "Compact Lighting Catalouge", 4/1981, p. 128, Instant Start Lamps.

*Primary Examiner*—David Mis
*Attorney, Agent, or Firm*—Spensley Horn Jubas & Lubitz

[57] ABSTRACT

Two sheets of material at least one of which is transparent, the sheets being overlaid one upon the other and sealed together to form a gas-tight enclosure. One or more gas discharges can be initiated within the enclosure between a pair of electrodes along a predetermined path, the gas discharge path or paths comprising a plurality of adjacent elongate portions extending between and generally parallel to the sheets. The electrodes may be exposed within the enclosure and connected to a DC or AC electrical power source. Alternatively however the electrodes may be electrically insulated from the enclosure but connected to a high frequency AC electrical power source. The enclosure may be filled with low pressure gas in the manner of conventional discharge tubes.

22 Claims, 6 Drawing Sheets

FLAT LIGHT SOURCE

The present invention relates to a flat light source.

Flat light sources are known for illuminating for example display panels, the light sources comprising a series of discrete discharge tubes arranged adjacent to one another and energised by an external circuitry incorporating ballast or resistive loads. Light sources of this type are inevitably bulky and require a space behind the display screen which is a of considerable depth. In addition, conventional discharge tubes require a high over-voltage to initiate discharge and the time taken to fully initiate a discharge (the strike time) is considerable. The strike time can be reduced by increasing the overvoltage or using internal or external conductive strips extending along the length of each discharge tube. The known light sources are however difficult to operate over a wide temperature range and if the light output of the light source is to be controllable complex and bulky external dimming circuitry is required. The known light sources are not generally two terminal devices.

Because of the abovementioned disadvantges it has proved difficult to provide a flat light source of acceptable size for use in for example back-lighting liquid crystal displays.

A discharge lamp having a series of parallel elongate discharge compartments is described in Japanese Patent No. JP-A-57-180067. This provides an output equivalent to a series of separate discharge lamps in a compact structure but does not overcome the problems of slow discharge initiation and high minimum overvoltage to initiate a discharge.

Japanese Patent No. JP-A-59-127357 describes a discharge lamp in which a single discharge compartment is defined in a rectangular enclosure by dividing the enclosure into a series of elongate compartments which are interconnected end-to-end. A mechanically strong and compact structure results, but again the problems of high discharge initiation voltages and slow discharge initiation are not overcome.

It is an object of the present invention to provide a flat light source which obviates or mitigates the abovementioned problems.

According to the present invention there is provided a flat light source comprising two sheets of material at least one of which is transparent, the sheets being overlaid one upon the other and sealed together to form a gas tight enclosure which is filled with low pressure gas and within which at least one gas discharge can be initiated between a pair of primary electrodes along a predetermined elongate path, the gas discharge path or paths occupying a plurality of adjacent elongate volumes within the enclosure, characterised in that further electrodes are spaced apart along the length of the or each discharge path, each further electrode being connected to a respective capacitive, resistive or inductive impedance.

Preferably the primary electrodes are exposed within the enclosure and connected to a DC or AC electrical power source. Alternatively however the primary electrodes may be electrically insulated from the enclosure but connected to a high frequency AC electrical power source. An additional resistive, capacitive or inductive load may be placed in series with one or both of the primary electrodes in each pair.

The enclosure may be divided into plurality of parallel channels by spacers positioned between the sheets.

Each channel may be associated with a respective pair of primary electrodes, or alternatively the channels may be interconnected end to end to define a single passageway between a single pair of primary electrodes.

The impedances reduce the magnitude of the applied voltage required to initiate a discharge and can be arranged so as to avoid any need for variable loads to assist discharge initiation or dimming of the light output. The impedances also have the important practical functions of stabilising the gas discharges and allowing spacers to be used which do not touch the top and bottom sheets at all points.

Preferably each spacer in section tapers towards the said at least one sheet of material. Alternatively, each spacer is transparent and in section tapers away from the said at least one sheet of material. As a further alternative, each spacer in section may be curved adjacent each of the sheets, the surface of each spacer being coated with a reflective material adjacent the sheet remote from the said at least one sheet of material. A gap may be defined between each spacer and the said at least one sheet of material. Supports may be interposed between each spacer and the said at least one sheet of material to maintain the said gap. The supports may comprise projections printed on the said at least one sheet of material, of fibres extending across the spacers for example. A diffusing panel may be supported adjacent the said at least one sheet of material.

In one arrangement, each further electrode is connected to the respective impedance by a conductor supported on an internal surface of the enclosure beneath an insulating layer. Alternatively, each impedance is supported on an internal surface of the enclosure beneath an insulating layer, each further electrode being in contact with the respective impedance. Preferably each further electrode is exposed to the gas in the enclosure through a respective aperture in the said insulating layer. An even number of said further electrodes may be spaced apart along the length of the or each said elongate path, each further electrode being connected by the respective impedance to one or other of the primary electrodes, and each further electrode of each adjacent pair of further electrodes being connected by their respective impedances to different ones of the two primary electrodes. Each electrode and impedance may be connected in a circuit which is supported directly on the enclosure formed by the sealed together sheets of material to define a two-terminal device.

In order to improve the luminous efficiency of the light source, one or all of the surfaces exposed to the gas discharge may be coated with phosphor or fabricated from a phosphor containing material. Surfaces other than that of the transparent sheet may be coated with a reflective material.

Embodiments of the present invention will now be described, by way of example, with reference to the accompanying drawings, in which.

Figure 1:
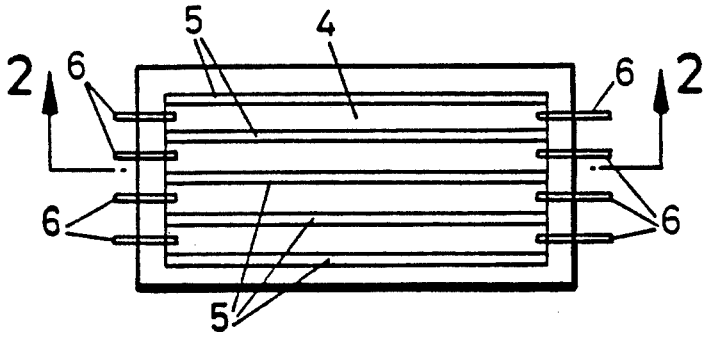
FIG. 1 is a plan view of a first primary electrode and enclosure arrangement, the further electrodes not being shown in this illustration, which is intended to show the basic enclosure and primary electrode layout only.
Figure 2:
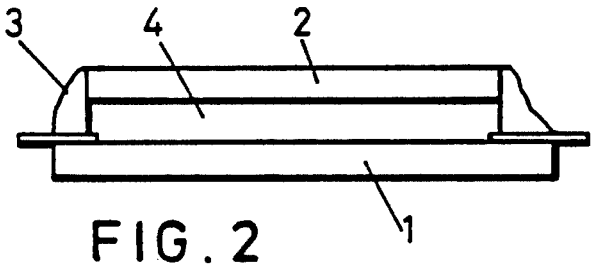
FIG. 2 is a sectional view taken on line 2—2 of FIG. 1.

Refferring to FIGS. 1 and 2, the illustrated structure comprises a lower sheet of material 1 and an upper transparent sheet of material 2. The sheets 1 and 2 are spaced apart in parallel and sealed around their perpheries by a sealing material 3 so as to define a gas-tight enclosure, the enclosure being divided into four parallel channels 4 by spacers 5.

Primary electrodes 6 are exposed within the channels 4 so that an electrical discharge may be initiated between the pair of electrodes positioned at opposite ends of the respective channel 4.

The channels are filled with a low pressure gas which may be of the type used in for example conventional discharge tubes and the surfaces of the channels may be coated with phosphor so as to increase the luminous efficiency of the device. The surfaces of the channels 4 other than the underside surface of the upper sheet 2 may be coated with a reflective material so as to improve the projection of light through the transparent upper sheet 2.

When a discharge is initiated in each of the channels 4 simultaneously a large area flat light source is defined. Such a light source may be used for example to backlight a liquid crystal display. The number and length of channels may be selected as necessary to provide the desired area and outline shape for that area.

Figure 3:
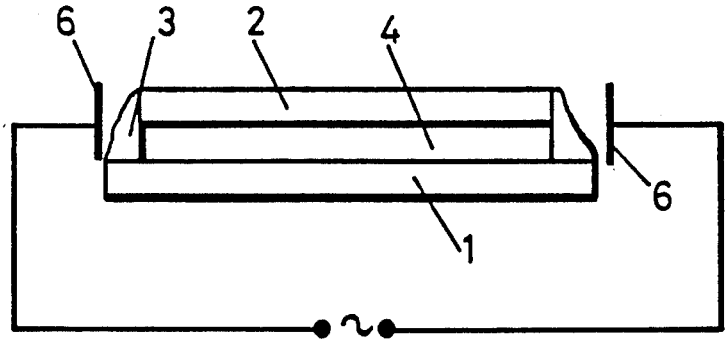
FIG. 3 illustrates features of a second arrangement incorporating an alternative primary electrode structure to that of the arrangement of FIGS. 1 and 2.

In the embodiment of FIGS. 1 and 2 the electrodes 6 extend into electrical contact with the gas within the channels 4. The electrodes 6 may however be electrically insulated from the channels 4 as illustrated in FIG. 3 providing a high frequency signal is applied between the terminals connected to electrodes 6.

Figure 4:
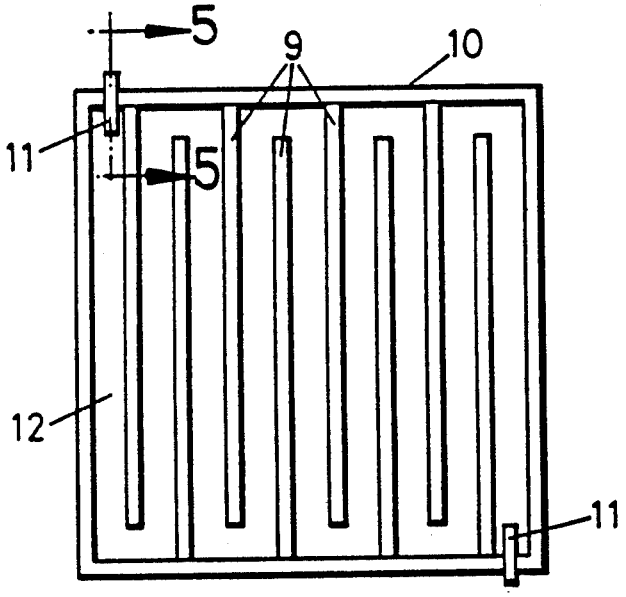
FIG. 4 is a plan view of a third arrangement, the further electrodes again not being shown.
Figure 5:
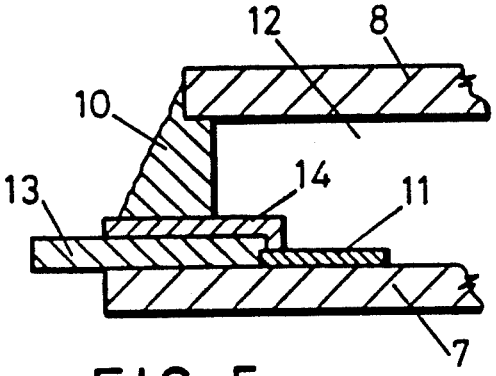
FIG. 5 is a sectional view on the line 5—5 of FIG. 4.

Referring now to FIGS. 4 and 5, in the illustrated arrangement a lower sheet 7 is seperated from an upper sheet 8 by series of spacers 9, the upper and lower sheets being sealed together around their peripheries by a seal 10. A single pair of primary electrodes 11 is provided, one electrode being positioned at each end of a circuitous single discharge path defined by the nine channels 12 which are connected end to end by virtue of the spacers 9, one end of each spacer stopping short of the adjacent portion of the seal 10.

As in the arrangement of FIGS. 1 and 2 the channels 12 are filled with a low pressure gas. When a discharge is initiated between the two electrodes 11 light is emitted from each of the channels 12 and thus a large area flat light source is defined.

FIG. 5 illustrates the connection of the electrode 11 to an external terminal 13. The electrode 11 is deposited on the upper surface of the lower sheet 7 and connected to the terminal 13 which is also deposited on the lower sheet 7. An insulating layer 14 is then laid over the junction between the electrode 11 and the terminal 13 and the seal 10 is then positioned so that the seal 10 and insulating layer 14 prevent direct electrical contact between the terminal 13 and the gas within the channel 12.

Figure 6:
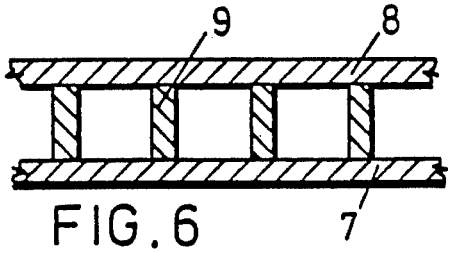
FIGS. 6 and 7 illustrate alternative spacer structures for use for example in the arrangement of FIG. 4.

In the arrangement of FIGS. 4 and 5 the spacers 9 may be simple strips of rectangular cross section as shown in FIG. 6. With such an arrangement however the top edges of the spacers 9 are visible when the light source is viewed through the upper sheet 8. To reduce the visible effects of the positioning of the spacers 9 various techniques may be used. For example the spacers 9 may be made of a transparent material such as glass and may be made as narrow as possible adjacent the upper sheet 8. For example spacers having a triangular cross section rather than the rectangular cross section as shown in FIG. 6 could be used. As an alternative when the spacers 9 are fabricated from a transparent material the spacers 9 may be made relatively wide close to the upper sheet 8 so that light transmitted into the spacer 9 is direct towards the upper sheet 8. In such an arrangement the spacer 9 could have a triangular cross section with one face of the triangle flat against the underside of the upper sheet 8. Other techniques for adjusting the visual impact of the spacers 9 may be used, for example by surface treatment, adjustment to the detailed geometrical shape, construction of the spacers from semi-transparent or diffusing material etc. A further method is to curve the surfaces of spacers 9, adjacent to the upper and lower blocks, and to coat the surface adjacent to the lower block with a reflective material.

Figure 7:
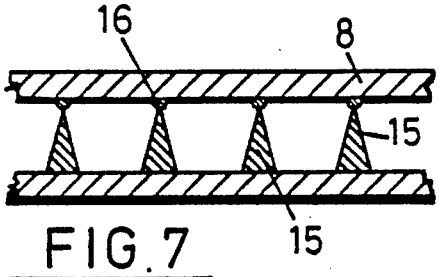

FIG. 7 shows an alternative spacer structure which substantially eliminates the visual impact of the spacers when the light source is viewed through the upper transparent sheet 8. In the arrangement of FIG. 7 each spacer comprises a portion 15 of triangular cross section which spaced from the upper sheet 8. Thus the spacers are not in contact with the upper sheet 8. Small "pips" 16 of a dielectric material are screen printed on the underside of the upper sheet 8 and contact the upper edges of the spacer portions 15. The functional effect of the pips 16 may be achieved in other ways, for example by using discrete thin support elements such as glass fibers extending across the top of the spacer portions 15.

As a further alternative, the pips 16 may be simply omitted providing the upper sheet 8 is sufficiently rigid to prevent it being sucked downwards in an irregular manner by the differential pressure across its thickness.

Figure 8:
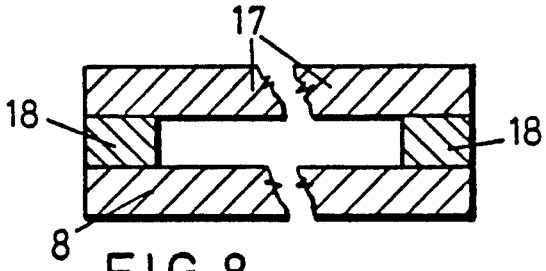
FIG. 8 illustrates a diffuser for use for example in embodiments of the the invention.

FIG. 8 illustrates a further structure which produces a more uniform light source. In the arrangement of FIG. 8 the upper sheet 8 of the light source (the lower sheet 7 not being shown) supports a diffusing panel 17 on edge spacers 18. This produces a very uniform light source but at the expense of increasing the overall thickness of the device. Alternatively the diffuser may be in contact with the upper block or incorporated as part of the upper block.

It will be noted from the above that it is not necessary for the spacers 9 to be sealed at their upper and lower edges to the upper and lower sheets 7 and 8. Depending on th length, width and overall dimensions of the light source the barriers represented by the spacers between adjacent discharge channels may vary considerably. It is simply necessary to provide sufficiently extensive barriers to ensure that a discharge in one channel does not prevent the initiation of a discharge in an adjacent channel.

Figure 9:
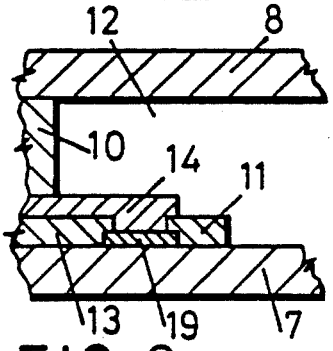
FIG. 9 illustrates the provision of a resistor in series with a primary electrode.

In the arrangement of FIGS. 4 and 5 the electrodes 11 are directly connected to the terminals 13. Accordingly if any ballast resistors are required these must be provided external to the enclosure defined by the light source. As an alternative however and as illustrated in FIG. 9 a resistor 19 may be deposited on the lower sheet 7 so as to be connected in series between the electrode 11 and the terminal 13. The resistor 19 is electrically insulated from the discharge channel 12 by the layer 14 of insulating material. It will of course be appreciated that the resistor 19 could be placed beneath the seal 10 or alternatively on the surface of the lower sheet 7 external to the seal 10.

Figure 10:
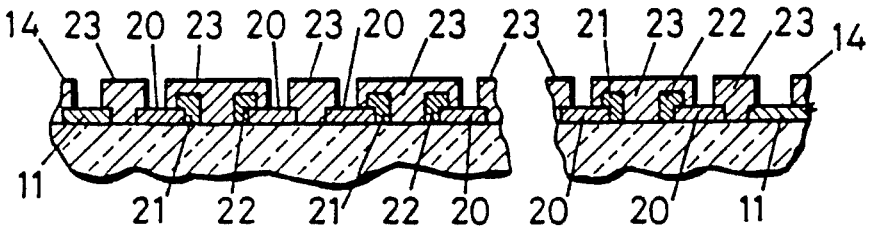
FIGS. 10 and 11 show in detail structures incorporating further electrodes with the enclosure in accordance with the present invention.

The voltage required to initiate a discharge in one of the channels 12 is reduced and the overall stability of the gas discharge or discharges is improved in accordance with the present invention by arranging a series of further electrodes along the length of the channels. Such an arrangement is illustrated in FIG. 10 in which the top surface of the lower sheet 7 is shown as supporting between the electrodes 11 a series of secondary electrodes 20 each individually connected by a series of electrical conductors 21 and 22 to an external resistive, inductive or capacitive ballast (not shown). It will be appreciated that the electrodes 20 and 11 are exposed to the gas discharge through respective holes in the adjacent dielectric. The electrodes are not located in open channels in the dielectric. The electrical conductors 21 and 22 are electrically insulated from the gas in the channel with which they are associated by a layer of insulating material 23. As described in further detail below, the electrical conductors 21 and 22 linked electrically together in two groups via respective series ballast impedances and conductors external to the discharge enclosure. It is possible to place a plurality of electrodes 20 across the width of each channel so that each group of electrodes extending across the width of the channel can be considered as constituting a single further electrode in the series of such electrodes spaced apart between the primary electrodes 11. Detailed circuits for use with a structure such as that illustrated in FIG. 10 are described below.

Figure 11:
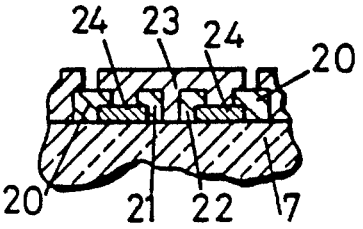

Referring now to FIG. 11, this illustrates a structure which enables an impedance in the form of a resistive element 24 to be placed on the lower sheet 7 in series with each electrode 20 and each electrical conductor 21 or 22. The electrical conductors 21 or 22 connect all the resistive elements 24 in rows extending perpendicular to the channels. The resistors 24 are electrically insulated from discharges by the layer of insulating material 23. The electrical supply to the device will be appreciated from the detailed circuits desrcibed below.

The formation of the electrodes. resistors, conductors and insulation layers on the lower sheet 7 may be achieved in any convenient manner. For example components may be deposited by printing, vapour deposition or any other conventional techniques including physical insertion of discrete components where appropriate.

Preferably the lower sheet is coated with phosphor. It may be necessary to clean the electrode surfaces after the phosphor coating is applied. The electrodes may be cleaned more easily by increasing the thickness of the electrodes to make them project above the level of the insulating material covering the conductors. Alternatively the cleaning process may be eliminated by placing the electrodes beneath the spacer elements, such that the electrodes remain in electrical contact with the gas, with the spacers having a maximum width in the vicinity of the electrodes. The phosphor coating may then be sprayed in such a fashion that the electrodes are shielded from any phosphor coating.

Figure 12:
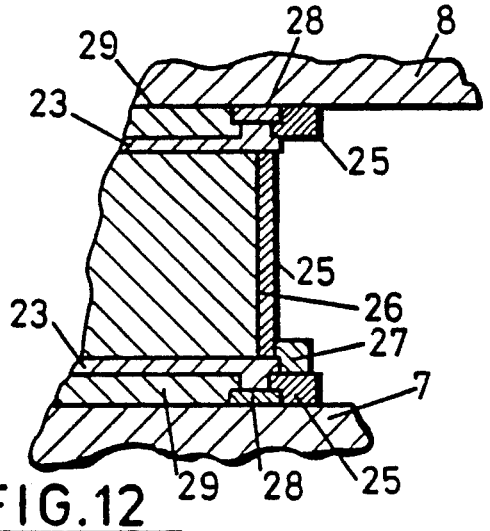
FIG. 12 illustrates a structure in which an electrode is defined on a side surface of an enclosure defined by an embodiment of the present invention.

In the embodiments described above all the various components have been supported on the lower sheet 7. This means that the area used by these components is relatively large when the device is viewed through the upper transparent sheet 8. This area may be reduced however by using surfaces perpendicular to the two sheets to support the various electrodes and other electrical components. Such an arrangement is shown in FIG. 12. Electrodes 25 are for example silk screed printed on the upper sheet 8 and lower sheet 7 and on to the surface 26 perpendicular thereto. An internal conductive connection 27 is made between the electrode 25 to the lower sheet and the perpendicular surface 26. The electrodes on the upper and lower sheets and resistors 28 are connected together externally by linking conductors 29. A single load resistor could be used common to both the upper and lower block electrodes.

Figure 13:
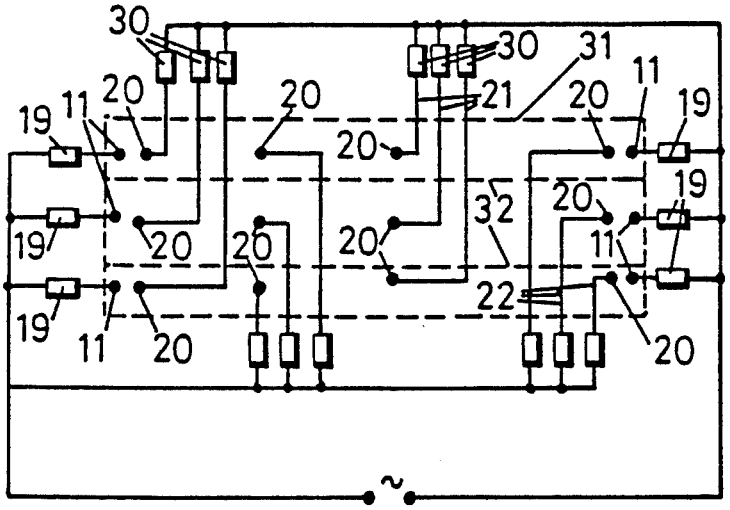
FIGS. 13 and 14 are circuit diagrams illustrating the connection of an embodiment of the invention to AC and DC power sources respectively.
Figure 14:
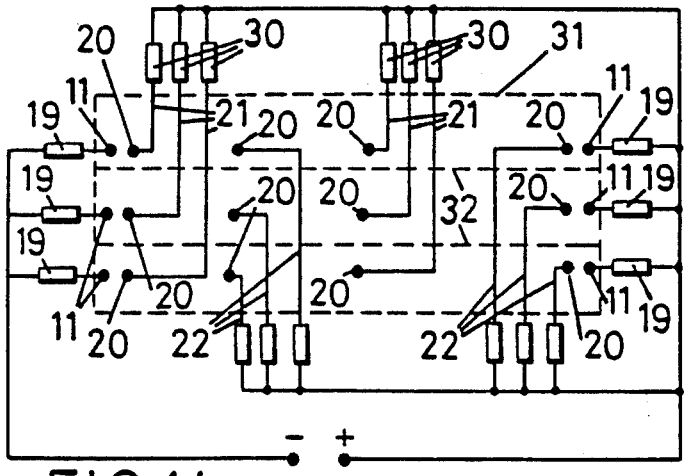

FIGS. 13 and 14 illustrate the circuit of an embodiment constructed to comprise the components described with reference to FIGS. 9 and 10. Ballast impedance resistors 30 are provided as described with reference to but not illustrated in FIG. 10. The perimeter of the gas filled enclosure is indicated by dotted line 31 and the position of spacers dividing the enclosure into three independent discharge channels are indicated by dotted lines 32. FIG. 13 illustrates the circuit for AC energisation and FIG. 14 the circuit for DC energisation.

Figure 15:
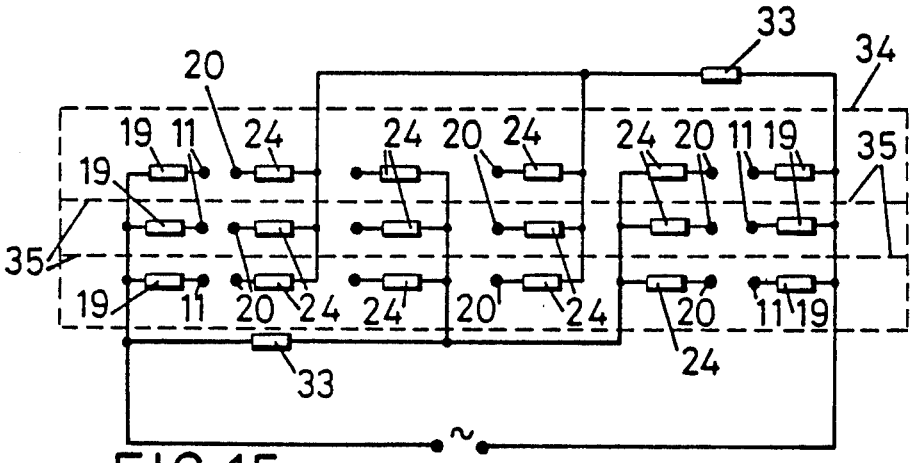
FIGS. 15 and 16 illustrate alternative embodiments of the invention connected to AC and DC power sources respectively.
Figure 16:
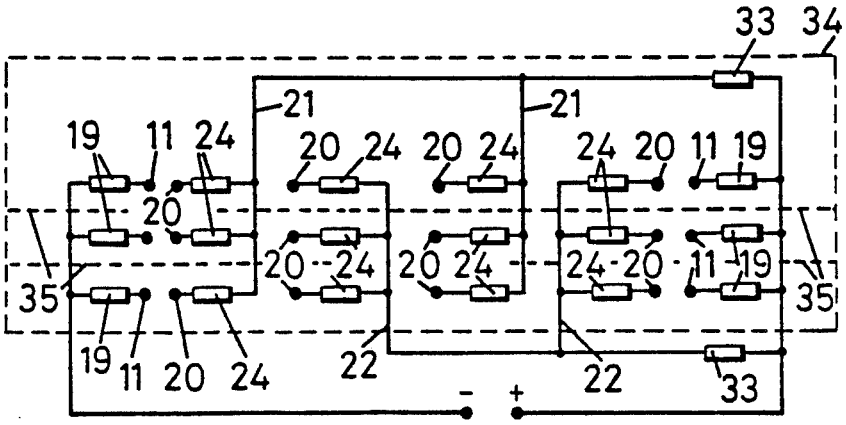

FIGS. 15 and 16 illustrate the circuits of embodiment similar to those illustrated in FIGS. 13 and 14 but incorporating the resistors 24 as illustrated in FIG. 11. Current limiting resistors 33 are also provided. The perimeter of the enclosure is indicated by dotted lines 34 and spacers seperating the enclosure into three independent discharge channels are indicated by dotted lines 35. The current limiting resistors 33 could, of course, be incorporated within the perimeter of the enclosure as could the external conductors shown in FIGS. 15 and 16 thereby producing a two terminal device.

I claim:

1. A flat light source comprising two sheets of material at least one of which is transparent, the sheets being overlaid one upon the other and sealed together to form a gas tight enclosure which is filled with low pressure gas and within which at least one gas discharge can be initiated between a pair of primary electrodes along a predetermined elongate path, the gas discharge path or paths occupying a plurality of adjacent elongate volumes within the enclosure, characterised in that further electrodes are spaced apart along the length of the or each discharge path, each further electrode being connected to a respective capacitive, resistive or inductive impedance.

2. A flat light source according to claim 1, wherein the primary electrodes are exposed within the enclosure and arranged for connection to a DC or AC electrical power source.

3. A flat light source according to claim 1, wherein the primary electrodes are electrically insulated from the enclosure and arranged for connection to a high frequency AC electrical power source.

4. A flat light source according to any claim 1 wherein the enclosure is divided into a plurality of parallel channels by spacers positioned between the sheets, each channel defining a said elongate volume.

5. A flat light source according to claim 4, wherein each channel is associated with a respective pair of primary electrodes.

6. A flat light source according to claim 4, wherein a plurality of the channels are interconnected end to end to define a single passageway between a single pair of primary electrodes.

7. A flat light source according to claim 4, 5 or 6, wherein each spacer in section tapers towards the said at least one sheet of material.

8. A flat light source according to claim 4, 5 or 6, wherein each spacer is transparent and in section tapers away from the said at least one sheet of material.

9. A flat light source according to claim 4, 5 or 6, wherein each spacer in section is curved adjacent each of the sheets, the surface of each spacer being coated with a reflective material adjacent the sheet remote from the said at least one sheet of material.

10. A flat light source according to claims 4, 5, or 6, wherein a gap is defined between each spacer and the said at least one sheet of material.

11. A flat light source according to claim 10, comprising support means interposed between each spacer and the said at least one sheet of material to maintain the said gap.

12. A flat light source according to claim 11, wherein the support means comprise projections printed on the said at least one sheet of material.

13. A flat light source according to claim 11, wherein the support means comprise fibres extending across the spacers.

14. A flat light source according to claim 1, comprising a diffusing panel supported adjacent the said at least one sheet of material.

15. A flat light source according to claim 1, wherein each further electrode is connected to the respective impedance by a conductor supported on an internal surface of the enclosure beneath an insulating layer.

16. A flat light source according to claim 1, wherein each said impedance is supported on an internal surface of the enclosure beneath an insulating layer, each further electrode being in contact with the respective impedance.

17. A flat light source according to claim 15 or 16, wherein each further electrode is exposed to gas in the enclosure through a respective aperture in the said insulating layer.

18. A flat light source according to claim 1, comprising a plurality of said further electrodes spaced apart along the length of the or each said elongate path, each further electrode being connected by its respective impedance to one or other of the primary electrodes, and each further electrode of each adjacent pair of further electrodes being connected by the respective impedances to different ones of the two primary electrodes.

19. A flat light source according to claim 1, wherein an additional resistive, capacitive or inductive load is connected in series with one or both of the or each pair of primary electrodes.

20. A flat lilght source according to claim 19, wherein each electrode and impedance is connected in a circuit which is supported directly on the enclosure formed by the sealed together sheets of material to define a two-terminal device.

21. A flat light source according to claim 1, wherein at least one of the surfaces exposed to the or each gas discharge is coated with phosphor or fabricated from a phosphor containing material.

22. A flat light source according to claim 1, wherein surfaces exposed to the low pressure gas other than that of the transparent sheet are coated with a reflective material.

* * * * *